United States Patent [19]

Umlauft et al.

[11] Patent Number: 4,974,845

[45] Date of Patent: Dec. 4, 1990

[54] BALL BEATER AS WELL AS PROCESS FOR PRODUCING SAME

[75] Inventors: Helmut Umlauft, Hard; Karl-Heinz Waeger, Goetzis, both of Austria

[73] Assignee: Head Sportgeraete Gesellschaft m.b.H. & Co. OHG., Wuhrkopfweg, Austria

[21] Appl. No.: 420,622

[22] Filed: Oct. 10, 1989

Related U.S. Application Data

[63] Continuation of Ser. No. 99,918, Sep. 22, 1987, abandoned.

[30] Foreign Application Priority Data

Sep. 23, 1986 [AT] Austria ..... 2546/86

[51] Int. Cl.[5] ..... A63B 49/00

[52] U.S. Cl. ..... 273/73 C; 273/73 F

[58] Field of Search ..... 273/73 C, 73 F, 73 R

[56] References Cited

U.S. PATENT DOCUMENTS

| | | | |
|---|---|---|---|
| 1,960,477 | 5/1934 | Cowdery | 124/23 R |
| 2,274,788 | 3/1942 | Hatton | 273/73 |
| 2,923,652 | 2/1960 | Oka | 273/73 R |
| 3,083,968 | 4/1963 | Takahashi | 273/73 R |
| 4,019,736 | 4/1977 | Lehew | 273/73 R |
| 4,042,238 | 8/1977 | Theriault | 273/73 |
| 4,062,541 | 12/1977 | Marks | 273/73 R |
| 4,177,990 | 12/1979 | Kajiwara | 273/73 C |
| 4,181,301 | 1/1980 | Cholat-Serpoud et al. | 273/73 C |
| 4,192,506 | 3/1980 | Sofia | 273/73 R |
| 4,200,285 | 4/1980 | Petitti, Jr. | 273/73 R |
| 4,220,335 | 9/1980 | Nobbs | 273/73 R |
| 4,221,382 | 9/1980 | Cooper et al. | 273/73 F |
| 4,314,699 | 2/1982 | Bayer et al. | 273/73 |
| 4,399,992 | 8/1983 | Molitor | 273/73 F |

FOREIGN PATENT DOCUMENTS

| | | | |
|---|---|---|---|
| 1578654 | 8/1971 | Fed. Rep. of Germany . | |
| 2631288 | 1/1977 | Fed. Rep. of Germany . | |
| 2328371 | 2/1978 | Fed. Rep. of Germany . | |
| 7530581 | 10/1975 | France . | |
| 7629987 | 9/1976 | France . | |
| 8503300 | 1/1987 | Netherlands | 273/73 C |

*Primary Examiner*—Randall L. Green
*Assistant Examiner*—Gary Jackson
*Attorney, Agent, or Firm*—Finnegan, Henderson, Farabow, Garrett & Dunner

[57] ABSTRACT

A racket has a racket frame (1) and a handle portion provided with an outer shell embracing at least the racket frame. The outer shell, which is wear-resistent and made of tough synthetic plastic material, has at least one slot which has edges that can be connected with one another along mutually opposing edges. The outer shell can be a slotted tube or hose fitted onto the frame, or a pre-shaped outer shell corresponding to the outer contour of the frame with at least one slot, or an outer shell having at lest first and second shell portions (2, 3) that are at least partially embracing the racket frame to provide reliable protection at the edges or rounded areas of the frame.

8 Claims, 2 Drawing Sheets

BALL BEATER AS WELL AS PROCESS FOR PRODUCING SAME

This application is a continuation of application Ser. No. 099,918, filed Sept. 22, 1987 now abandoned.

BACKGROUND OF THE INVENTION

The invention is directed to equipment for use in racket sports, in particular a tennis-racket, comprising a racket frame tentered with tensioned strings, a handle portion, and an outer shell made of synthetic plastic materials at least partially embracing the racket frame.

There are several known processes for producing racket frames. It is known from DE-OS No. 33 43 889 to assemble such a racket frame of hollow profile by subdividing the plane of the tensioned strings. For the purpose of reliably providing the required strength of such hollow profiles, there can either be used a metallic material or a correspondingly highly reinforced synthetic plastic material. In both cases, the outer surface of the racket requires extensive machining to obtain a smooth surface. Several grinding and varnishing steps are required to be subsequently applied to the frame decorations or printings, which result in a relatively expensive finishing operation. Furthermore, there are environmental effects because of the solvent vapors from varnishes, which are usually applied by spraying. The varnish layers applied onto the outer surface of such rackets are relatively thin and withstand mechanical stress for only a limited time interval.

Frames of tennis rackets are subject to several kinds of mechanical stress. Any exerted bending stress or torsion stress may result in fracture when fiber-reinforced synthetic plastic materials are used. Varnish layers applied to the outer surface of such frames contribute nothing to stabilizing the frame, and if the frame fractures, there exists a substantial risk of injury from protruding frame parts or parts of reinforcing inserts.

FR-A No. 2 326 211 discloses a component part consisting of synthetic plastic material, which is pressed onto the racket frame in a form-locking manner. This component part represents a protective strip which is made in one piece and has its free ends separated from one another DE-AS No. 2 328 371 discloses a racket composed of metal and synthetic plastic material and having an inner flange and outer flange of the racket frame coated with protective layers of synthetic plastic material. These protective layers of synthetic plastic material cover the surfaces of both flanges and have a definite modulus of elasticity.

U.S. Pat. No. 4,042,238 discloses a sheathing for a racket consisting of synthetic plastic material, i.e. ABS (acrylonitrile butadiene styrene) copolymer.

Frame construction using shell portions must correspondingly be reinforced in the shell portions representing load-carrying constructional elements of the frame. Thus, these portions cannot have a smooth outer surface suitable for screen printing or lettering. All such frame constructions require extensive finishing operations. From AT-PS No. 362 269, it is known to assemble a frame from a plurality of wall members, wherein tongue-in-groove joints are used for the front walls and side walls for the purpose of improving stability. Also in such frame constructions, which require extensive assembling operations, the box-frame construction of the frame must fulfill a load-carrying function requiring the designing of synthetic plastic materials for the load-carrying function. The synthetic plastic materials must be of relatively high hardness, and thus there is an increased danger of fracturing. Correspondingly reinforced synthetic plastic materials do not have a smooth outer skin. Therefore, in addition to complicating the assembly of such rackets, expensive finishing operations are needed for producing a smooth outer surface.

SUMMARY OF THE INVENTION

The present invention overcomes the problems and disadvantages of the prior art by substantially reducing the finishing work required, after the tennis-racket is made, for applying lettering or decorations while simultaneously providing improved protection when the racket is subjected to mechanical stress. The invention essentially consists of a racket having a racket frame and a handle portion, wherein the racket frame is provided with an outer shell that is a tube or an outer shell pre-shaped to the frame contours or an outer shell having at least first and second shell portions which at least partially embrace the racket frame, and the outer shells have delimited by mutually facing edges at least one slot extending in the circumferential direction of the racket frame in parallel relation to the plane of the tensioned strings. The outer shells consist of tough elastic synthetic plastic materials having a smooth outer surface. At least one slot of the outer shells extending in circumferential direction of the racket frame may be closed by welding, by glueing, or by compressing within a mold. The handle portion may be optionally covered by the outer shells.

BRIEF DESCRIPTION OF THE DRAWINGS

The invention is explained in greater detail with reference to the embodiments shown in the drawings in which.

DETAILED DESCRIPTION OF THE PREFERRED EMBODIMENTS

Figure 1:
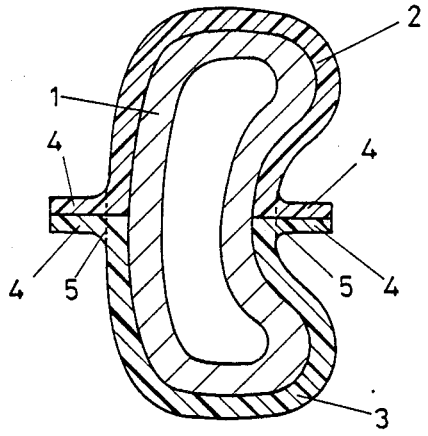
FIG. 1 shows a cross section through a racket frame.

According to the invention, where the outer shell is not directly used as the load-carrying element of the racket or the racket frame, the material selected for the outer shell can be of a correspondingly tough and elastic synthetic plastic materials having a smooth outer surface. The outer shell is slotted in the circumferential direction of the racket frame. The outer shell can, when producing equipment for use in racket sports, easily be fixed and positioned by clamping thereto the elastically expandable shell. By closing the outer shell having at least one slot by welding, glueing or compressing within a mold the finishing is simplified. There can be economically manufactured, in accordance to the invention, a racket having a smooth surface suitable for applying thereto lettering or the like and which provides simultaneously increased protection against mechanical stress by using the outer shell that is tube-like or pre-shaped or in shell portions.

When using an outer shell having at least first and second shell portions, there is equally reliably provided an effective protector for the edge of the racket frame. From the smooth outer surface provided by the material of the outer shell, it is possible to give the outer surfaces, and optionally also the inner surfaces of the racket, printing or lettering without expensive working steps.

When using an outer shell that is tube-like or pre-shaped, the slot extending in circumferential direction may be designed such that the racket can be fitted into the outer shell. The outer shell is, when producing the racket frame and the optionally covered hand portion, pressed thereagainst and is simultaneously glued or welded to these aforementioned parts. The plane of the slot may, for example, be located in the plane of the tensioned strings, although the edges of the slot may extend in parallel relation to the plane of the tensioned strings so that effective protection of the edges of the racket frame can be reliably provided by embracing parts of the outer shell.

An arrangement may advantageously be selected such that the outer shell that is tube-like and the outer shell having at least first and second shell portions are lapped or serrated at their mutually opposing edges, wherein the edges of the slot are alternatively or additionally overlapping one another in the plane of the tensioned strings. The design of the outer shell provides, beside the advantages of omitting any subsequent finishing operations, the advantage that assembling of the racket frame with the outer shell is possible in a particularly simple manner.

A reliable connection of the edges of the slot can be obtained if mutually opposite edges of the tube-like outer shell, or the outer shell pre-shaped to the frame contours, or the outer shell having at least first and second shell portions are designed to have bent flanges. In such an arrangement, there remains after effecting the connection, preferably by glueing or welding, bent flanges of mutually opposite edges of the slot protruding from the frame. These protruding parts, although the pressure exerted when effecting the connection or the welding operation used and of the thickness of the material used for the outer shell will be factors, are relatively thin and may easily be severed by means of simple cutting tools, thereby immediately obtaining a smooth outer contour and outer surface of the racket.

In a particularly advantageous embodiment, the outer shells can consist of thermoplastic synthetic plastic materials, in particular of 70 to 85 percent by weight, preferably 80 percent by weight, ABS (acrylonitrile butadiene styrene) copolymer and 15 to 30 percent by weight, preferably 20 percent by weight, polyamide 6-6. It has surprisingly been found that such synthetic plastic materials result in extremely high mechanical stability with simultaneously accompanying excellent smooth outer surfaces for relatively thin outer shells. When using such shells of synthetic plastic materials, no additional finishing work is subsequently required before applying decorations or lettering, so that the production process can be substantially more efficient.

The outer shells may have a relatively small thickness; for example, a thickness of 0.2 to 3 mm, because it will not function as a load carrying element, but only as an element improving the appearance of the surface. The selection of a tough and elastic synthetic plastic materials reduces the danger of injury, in particular after a failure of the racket frame, because outer shells consisting of tough and elastic synthetic plastic materials will reliably hold together the ruptured parts.

The inventive process for producing such equipment for racket sports is substantially characterized in that the outer shell of synthetic plastic materials, with an optionally interposed layer of adhesive, is applied onto a racket frame, consisting of pre-hardened and fiber-reinforced synthetic plastic material or metal having tensioned strings, by clamping. The result is the elastic deformation of the shell material and attachment by glueing or welding with the racket frame under the action of heat and pressure. The shell portions are also welded or glued and pressed within a mold with one another along at least one edge extending in parallel relation to the plane of the tensioned strings. Since the shell portions partially embrace the racket frame, the positioning of the shell portions prior to the subsequent glueing step or welding step becomes particularly simple, and it is possible to use in an advantageous manner as the core for the racket frame partially cured synthetic plastic materials, which became completely cured while being thermally welded and pressed with the outer shell. The production speed thus becomes substantially increased, and a finished tennis racket suitable for being immediately provided with a decoration is obtained in one single process step which omits extensive positioning operations.

During assembly the shell portions are welded, glued, or pressed within a mold with one another along at least one edge extending in parallel relation to the plane of the tensioned strings. In this case, the term "edge" always means the border of the shell portion or of the slot, respectively. Since the slot is arranged such that the shell at least partially embraces the racket frame and because even when using two shell portions the arrangement is such that both shell portions embrace the racket frame at their edges, the edges or the borders of the slot are located within the area of the sidewalls of the racket frame.

The outer shell may be applied in a particularly simple manner in case of racket constructions comprising a throat being separated from the frame. In this case, the procedure requires that the outer shell be formed of a tube or hose being slotted in its longitudinal direction and being fitted over the racket frame.

When there are bent flanges on the shell portions, there remains after the pressing operation or welding operation protruding parts which can subsequently be removed.

In FIG. 1, the frame of a racket is designated by 1. This racket frame forms a wall, the shape of which is predetermined by the tool used for producing the frame. Two pre-fabricated shell portions 2 and 3, which are designed as shell halves, are fitted over the outer wall of the frame 1. Both shell portions 2 and 3 in this embodiment have laterally protruding flanges 4, which are connected to one another by a pressing operation or a welding operation under the influence of heat during the assembly operation when forming the racket frame. During this procedure, there occurs, simultaneously under the influence of heat, glue, or welding attachment of the shell portions with the racket frame. The protruding flanges are subsequently removed along the dashed lines 5 by means of a simple severing tool so that a racket frame having a smooth outer shell is immediately obtained.

Figure 2:
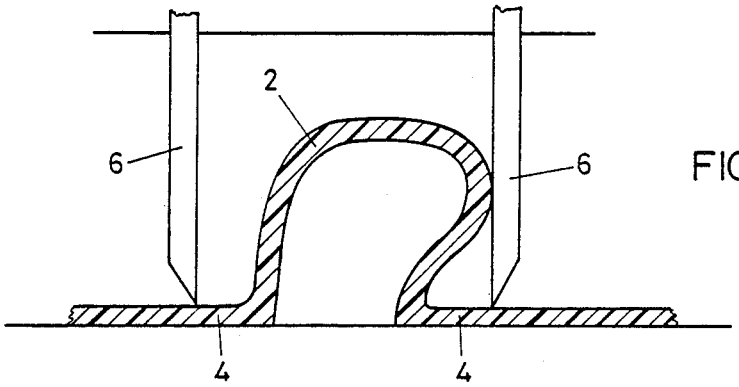
FIG. 2 shows a process step for producing a shell portion for the embodiment according to FIG. 1.
Figure 3:
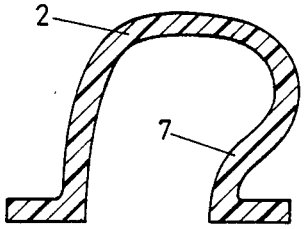
FIG. 3 shows a prefabricated shell portion suitable for the embodiment according to FIG. 1.

The parts for use as the outer shell as shown in FIG. 2 can be produced of tough elastic synthetic plastic material by a pre-shaping operation. The pre-shaping operation may, for example, be a deep drawing operation or hot work forming depending on the material used. Deep drawing or hot shaping is of particular interest. After the shaping operation, the shell portions are separated by two knife cuts by means of knives 6 whereby the protruding flanges 4 are allowed to remain. The shell portions produced in this manner are shown in FIG. 3. On account of inwardly bent portion 7, the shell portion 2 may be mounted on the racket frame 1 in a simple manner by elastic expanding, so that an extensive positioning operation may be omitted.

Figure 4:
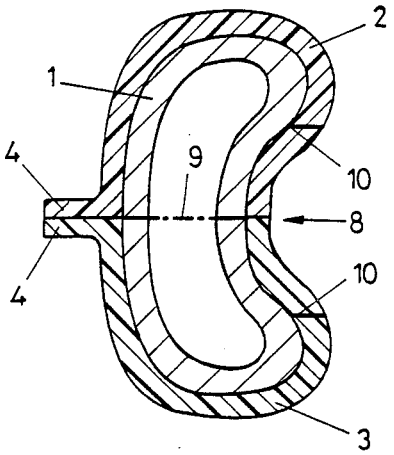
FIG. 4 shows a modified embodiment of that shown in FIG. 1.

In the embodiment shown in FIG. 4, the shell portions 2 and 3 are pressed against the outer side of the racket frame 1 with simultaneous plastic deformation. For this purpose, a heated stamp may be pressed against the outer side of the racket frame at the location indicated by the arrow 8, which reliably provides a smooth outer contour. Also in this embodiment, there remains at the inner side of the racket frame a protruding flange 4 which can be severed after the welding operation. Beside a joining plane, as is indicated in FIG. 4 by the reference numeral 9, the edges of the shell portions may be terminated, for example at the locations indicated by the reference numerals 10, so that a central area is left unoccupied. In this embodiment, a partially form-locking covering of the racket frame 1 is provided, whereby the mechanical stability is still substantially improved. A shell portion 2 being suitable for the embodiment according to FIG. 4 is shown in FIG. 5.

The racket frame 1 can be made of a material which has not been completely cured and is subsequently completely cured simultaneously with the welding operation used for welding the shell portions 2 and 3.

Figure 5:
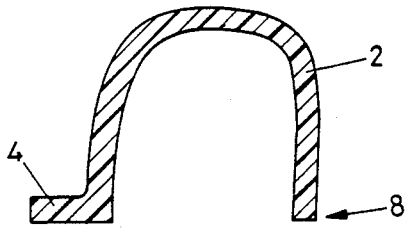
FIG. 5 shows a shell portion suitable for the production of equipment for use in racket sports according to FIG. 4.

In the place of the laterally protruding flanges 4 shown in FIGS. 4 and 5, the shell portions 2 and 3 can be integrally connected, and in this case, the edges 10, as shown in FIG. 4, may be provided as the slot edges of such a one-piece shell. In these cases, the outer shell pre-shaped to the frame contour is a one-piece shell consisting of the portions 2 and 3, which are clamped onto the racket frame by expanding the slot delimited by the slot edges 10. Extensive positioning operations for the subsequent welding operation or glueing operation are not necessary. When using a one-piece shell, the continuous area located at the outer side, including the opposite side of the slot edges 10, advantageously extends at least beyond the upper edge of the racket head so that additional mechanical protection results by selecting a correspondingly tough and elastic material. The outer shell, which has no load carrying function of its own, may be designed to have an attenuating function and shock absorbing function. All of these functions can be obtained with the use of non-reinforced synthetic plastic materials so that a smooth outer surface can be obtained.

Other embodiments of the invention will be apparent to those skilled in the art from consideration of the specification and practice of the invention disclosed herein. It is intended that the specification be considered exemplary only, with the true scope and spirit of the invention being indicated by the following claims.

What is claimed is:

1. A racket comprising:

a racket frame having an outer contour and a handle portion connected to said racket frame, wherein the racket frame is tentered with tensioned strings, which form a surface that lies in a plane; and an outer shell of tough, elastically expandable, synthetic plastic material having a smooth outer surface, which is fitted over and at least partially embraces said racket frame;

wherein said outer shell is provided with at least one slot extending in parallel relation to said plane of the tensioned strings to allow said outer shell to be fitted over and to embrace said racket frame.

2. A racket comprising:

a racket frame having an outer contour and a handle portion connected to said racket frame, wherein the racket frame is tentered with tensioned strings, which form a surface that lies in a plane; and an outer shell of tough, elastically expandable, synthetic plastic material having a smooth outer surface, which is fitted over and at least partially embraces said racket frame;

wherein said outer shell comprises at least first and second shell portions having edges, whereby said edges of said first shell portion are positioned mutually opposing said edges of said second shell portion to thereby form at least one slot.

3. A racket comprising:

a racket frame having an outer contour and a handle portion connected to said racket frame, wherein the racket frame is tentered with tensioned strings, which form a surface that lies in a plane; and an outer shell of tough, elastically expandable, synthetic plastic material having a smooth outer surface, which is fitted over and at least partially embraces said racket frame;

wherein said outer shell is provided with at least one slot extending in parallel relation to said plane of the tensioned strings to allow said outer shell to be fitted over and to embrace said racket frame;

and further wherein said outer shell has mutually opposing edges that are provided with flanges.

4. A racket comprising:

a racket frame having an outer contour and a handle portion connected to said racket frame, wherein the racket frame is tentered with tensioned strings, which form a surface that lies in a plane;

an outer shell of tough, elastically expandable, synthetic plastic material having a smooth outer surface, which is fitted over and at least partially embraces said racket frame;

wherein said outer shell comprises at least first and second shell portions having edges, wherein said edges of said first shell portion are positioned mutually opposing said edges of said second shell portion to thereby form a least one slot;

and further wherein said mutually opposing edges of said first and second shell portions are provided with flanges.

5. A racket comprising:

a racket frame having an outer contour and a handle portion connected to said racket frame, wherein the racket frame is tentered with tensioned strings, which form a surface that lies in a plane; and an outer shell of tough, elastically expandable, synthetic plastic material having a smooth outer surface, which is fitted over and at least partially embraces said racket frame;

wherein said outer shell is provided with at least one slot extending in parallel relation to said plane of the tensioned strings to allow said outer shell to be fitted over and to embrace said racket frame;

and further wherein said outer shell comprises a thermoplastic, synthetic, plastic material of 70% to 85% by weight of acrylonitrile butadiene styrene copolymer and 15% to 30% by weight of polyamide 6-6.

6. A racket as claimed in claim 30, wherein said outer shell comprises a thermoplastic, synthetic, plastic material of 80% by weight of acrylonitrile butadiene styrene copolymer and 20% by weight polyamide 6-6.

7. A racket comprising:

a racket frame having an outer contour and a handle portion connected to said racket frame, wherein the racket frame is tentered with tensioned strings, which form a surface that lies in a plane; and an outer shell of tough, elastically expandable, synthetic plastic material having a smooth outer surface, which is fitted over and at least partially embraces said racket frame;

wherein said outer shell is provided with at least one slot extending in parallel relation to said plane of the tensioned strings to allow said outer shell to be fitted over and to embrace said racket frame;

wherein said outer shell is a tube;

and further wherein said outer shell comprises a thermoplastic, synthetic plastic material of 70% to 85% by weight of acrylonitrile butadiene styrene copolymer and 15% to 30% by weight of polyamide 6-6.

8. A racket as claimed in claim 7, wherein said outer shell comprises a thermoplastic, synthetic, plastic material of 80% by weight of acrylonitrile butadiene styrene copolymer and 20% by weight polyamide 6-6.

* * * * *